United States Patent [19]

Angebault et al.

[11] Patent Number: 4,756,343

[45] Date of Patent: Jul. 12, 1988

[54] METHOD AND DEVICE FOR THE INSERTION OF WEFT YARNS INTO THE SHED OF A WEAVING MACHINE

[75] Inventors: Joël Angebault, Riedisheim, France; Albert Moessinger, Epalinges, Switzerland

[73] Assignee: Societe Alsacienne de Materiel Textile, Mulhouse, France

[21] Appl. No.: 945,502

[22] Filed: Dec. 23, 1986

[30] Foreign Application Priority Data

Dec. 31, 1985 [FR] France ..... 85 19571

[51] Int. Cl.[4] ..... D03D 47/28

[52] U.S. Cl. ..... 139/443

[58] Field of Search ..... 139/429, 443, 450

[56] References Cited

U.S. PATENT DOCUMENTS 4,479,518 10/1984 Kiwior ..... 139/443
4,509,563 4/1985 Gosciniak et al. ..... 139/443
4,544,001 10/1985 Moessinger et al. ..... 139/443
4,553,570 11/1985 Moessinger et al. ..... 139/443

FOREIGN PATENT DOCUMENTS 2506795 9/1983 France .

*Primary Examiner*—Henry S. Jaudon
*Attorney, Agent, or Firm*—Parkhurst & Oliff

[57] ABSTRACT

A process for inserting weft lengths into the shed of a loom including a metering-delivering device that supplies a storage member for storing a predetermined length of yarns. The yarn length is caught between the outlet of the delivering device and the storage member in order to be inserted into the shed formed by the warp yarns. The yarn length is then cut and operationally gripped close to the selvedge of the fabric. The cut end of the yarn is held over before being re-introduced in the storage member for the next insertion, the cut end of the yarn being held over in an independent circuit outside the path joining the outlet of the delivering device to the inlet of the storage member. Re-introduction of the yarn into the storage member is performed so that the cut end is re-introduced as a loop unwinding from a fixed point at the outlet of the delivering device as far as the inlet of the storage member under the action of an air stream, the weft yarn being only re-subjected to the action of the delivering device when it has completely unwound and stretched out under the action of a suction nozzle.

7 Claims, 3 Drawing Sheets

A
B
C

METHOD AND DEVICE FOR THE INSERTION OF WEFT YARNS INTO THE SHED OF A WEAVING MACHINE

BACKGROUND OF THE INVENTION

The present invention relates to the textile industry and more particularly to an improvement in shuttleless looms in which the weft is inserted from feed bobbins (or like supports) situated outside the shed.

Such looms use different types of means for inserting the weft into the shed, such as for example: jets of fluid, nozzles or throwing members with gripping means, the kinetic energy of the weft yarn, etc.

In most of these looms, the weft yarn to be inserted is prepared beforehand into lengths or picks corresponding to the wanted machine width and stored successively in a reserve member before being inserted into the shed.

In all these looms, the main problem arising is that of the re-introduction of the end of the cut weft into the reserve member. This problem which is already known to arise in looms using only one type of weft yarn (production of plain woven fabrics) is amplified in multiweft looms used in the production of fancy fabrics and requiring the insertion, according to a predetermined sequence, of weft yarns of different color and/or nature.

It is the object of the present invention to solve the aforesaid problem.

In the description given hereinafter, the invention is applied to shuttless looms in which the weft is inserted into the shed formed by the warp yarns according to the technique known as "insertion-by-inertia" and which is described for example in published French Pat. Nos. 2 477 587 (corresponding to U.S. Pat. No. 4,509,563) and 2 495 196 (corresponding to U.S. Pat. No. 4,479,518). This of course is not in any way restrictive, and the invention may also be applied to any other weaving technique where similar problems may arise.

In general, said throwing-by-inertia technique, according to which the weft yarn is thrown into the shed in the form of a loop which unwinds, implies the preparation of the weft length before this is thrown. Said preparation consists in accumulating a metered length of yarn in a reserve situated between the yarn supply source (bobbin) and the side of the machine where the weft is due to be inserted, and then extracting the yarn from said reserve when it is about to be thrown. As described in the two aforesaid patents, extraction from the reserve can be carried out through the same channel as that through which the yarn was introduced, but in reverse. This therefore, necessarily implies a change of path for the yarn during those displacements, first from the metering-delivering device to the reserve, and second, from the reserve to the throwing member throwing the yarn in the direction of the shed.

This necessity is obvious from the teachings of French Pat. No. 2 477 587 (corresponding to U.S. Pat. No. 4,509,563). According to the solution described in that document, the change of path takes place without any special guiding, the yarn being thrown freely from one point to another to be thereafter deviated in another direction. This technical solution is very satisfactory but it is difficult to perform considering that the yarn passes freely close to the throwing member and that in that area, perturbing air streams may occur, especially when the throwing member is of the type with rotating impellers. Indeed, the position of the yarn may be deviated and the gripping of said yarn by the throwing member may be perturbed.

French Pat. No. 2 538 008 (corresponding to U.S. Pat. No. 4,544,001) describes a solution which makes it possible to overcome the aforesaid disadvantages, and which, in general, consists, as in fact mentioned in French Pat. No. FR 2 506 795, in placing the end of the yarn which has just been cut in a held over position, between the metering-delivering device and the storage means. Said cut end of the yarn is placed in said held-over position in the area extending between the inlet into the reserve and the outlet from the delivering device, by guiding channels which, if necessary, can be extended as far as close to the scissors for cutting the yarn on the selvedge of the material. With a loop permitting the insertion of various wefts according to a predetermined sequence, it is necessary to have as many channels as there are yarns in order to place said yarns in the held-over position before re-inserting them into the reserve. It should also be noted that in such a case, if the object is to make the holding-over circuits pass near the scissors in order to reduce the length of the yarn to be drawn out, then it is necessary to lengthen and to bend the circuits, hence a very complex construction. Certainly, this problem may be overcome in the end, as can be seen from the examples illustrated in FIGS. 7 and 8 of the aforesaid patent by placing said circuits aslant, but then, the part of the circuit situated at the outlet from the reserve and placed in facing relationship to the throwing rollers gripping line is at a distance from said line which is aslant, this impairing the firmness of the gripping during the actual throwing operation.

Finally, in all cases, when the weft yarn is reintroduced into the reserve, the cut end is re-introduced first into said reserve, generally under the action of an air stream which pushes the yarn, and entangling or bundling up of said end may occur, or generally, the cut end takes on a more or less sinuous form which perturbs the sequencing and the withdrawal of the yarn from the reserve for the throwing operation.

The present invention eliminates these drawbacks and relates to an improved method, applicable not only in the case of one-color looms, but also in the case of multi-color looms, and to a device for carrying out said method.

In general, the invention relates to an improvement in the process for inserting yarn lengths into the shed of a loom, wherein a metering-delivering device supplies a storage member in which a predetermined length of yarn is stored, said yarn length being caught in the interval between the delivering device outlet and the storage member, in order to be inserted into the shed formed by the warp yarns, then said yarn length is gripped close to the selvedge of the fabric and cut, the cut end of the yarn being held over before being re-introduced once again into the storage member for the next insertion, said improvement being characterized in that the cut end of the yarn is held over in an independent circuit outside the path connecting the outlet of the metering device and the inlet of the reserve, re-introduction of the yarn into the reserve being performed so that the cut end is reintroduced as a loop which unwinds from a fixed point at the outlet of the delivering device to the inlet of the reserve under the action of an air stream, and the weft yarn being subjected to the action of the delivering device only after it has completely unwound and stretched under the action of a nozzle.

According to this process, the end of the yarn, released after the cutting operation, is firmly held and guided throughout the whole phase of re-introduction into the reserve. Moreover, said process is particularly well adapted to be used with multi-weft looms, where the wefts are kept separate one from the other outside the throwing phase.

In summary, in the process according to the invention, after the cutting operation, the free end of the yarn is kept in a holding over circuit, and during the re-introduction, before the start of the metering phase, said free end is carried towards the reserve by means which exert a pulling action from a fixed point downstream of the metering device, this helping the cut end to enter evenly into the reserve.

The invention also relates to a device for carrying out said process, which device is essentially characterized in that temporary storage means (holding over channel) for the cut end of the yarn are provided between the outlet of the metering-delivering device and the cutting member close to the selvedge, and this outside the path followed by the yarn, on the one hand, between the metering device and the reserve, and on the other hand, when the yarn is thrown from the reserve into the shed, said means keeping the yarn in stretched condition under the action of an air stream, before it is introduced into the reserve under the action of the metering device.

If the invention is applied to a one-color loom, the storage member is situated inside the throwing plane, whereas if the invention is applied to a multi-color loom, there must be as many storage members as there are weft lengths to be inserted, said storage members being so oriented as to to guide the yarn within a plane cutting through the throwing plane, the yarns being then stored in n planes converging towards the throwing plane.

BRIEF DESCRIPTION OF THE DRAWINGS

The invention will be more readily understood on reading the following description with reference to the accompanying drawings in which.

DETAILED DESCRIPTION OF THE PREFERRED EMBODIMENTS

Figures 1, 1A, 1B:
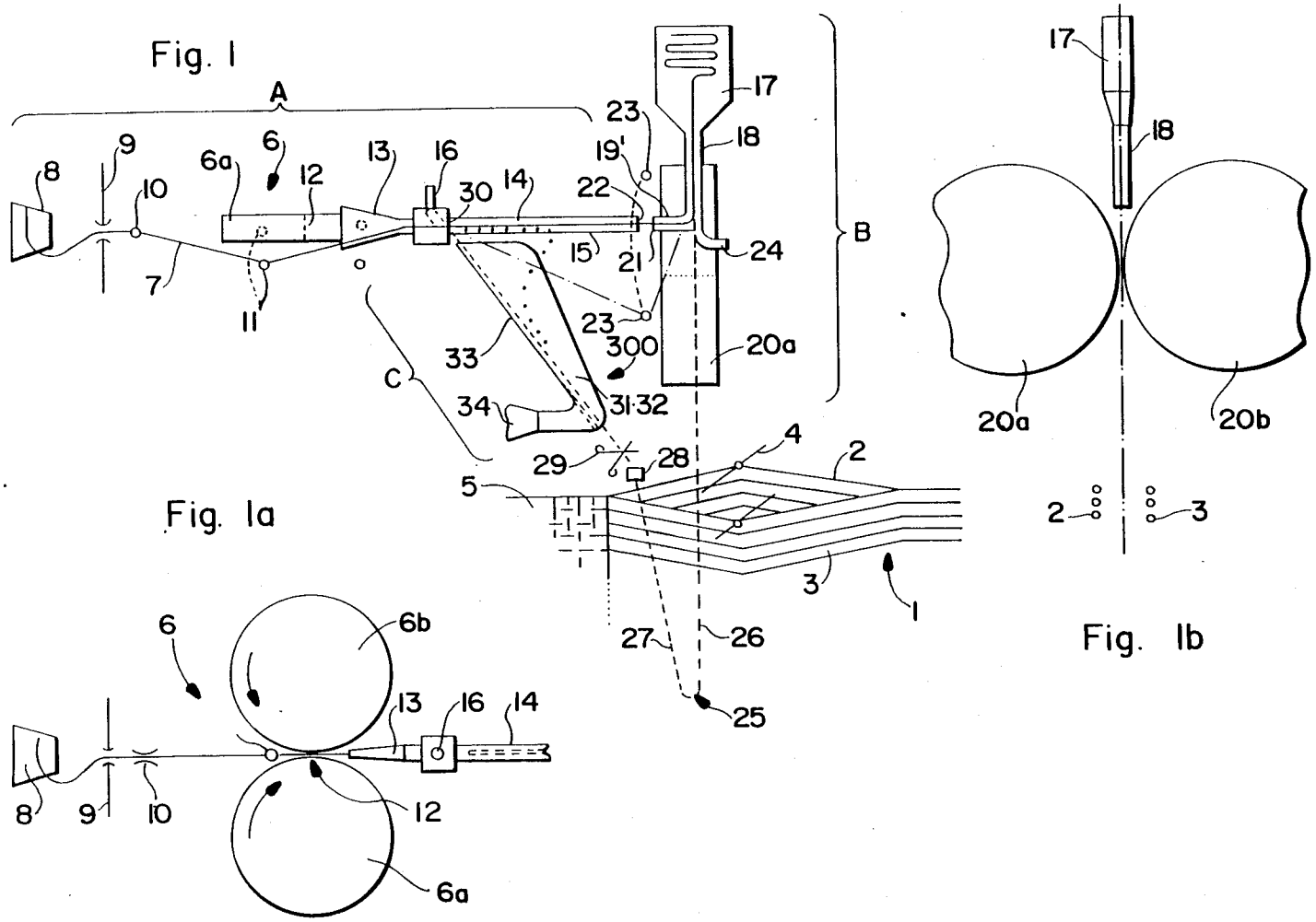
FIG. 1 diagrammatically illustrates how the yarn is stored, thrown and held over, according to a first embodiment for a monoweft insertion.
FIG. 1*a* is a diagrammatical side view of the metering device of FIG. 1.
FIG. 1*b* is a diagrammatical side view showing more particularly the throwing member of FIG. 1.

Referring first to FIGS. 1, 1*a*, 1*b*, these figures illustrate one embodiment of the process according to the invention carried out on a loom in which the weft is supplied from only one feed bobbin ("one-color or plain loom").

In general, this type of loom comprises, for inserting the weft yarn into the shed which is formed by the warp yarns (1) separated in two webs (2,3) by the heddles (4) and which is limited by the fabric (5), an assembly which can be subdivided into the following three zones:

a zone A called a feeding zone, permitting the delivering and metering of a predetermined length of weft corresponding to the weft length to be inserted;

a zone B called a storage and throwing zone, and a zone C called a holding over zone.

Zones A and B are produced in the same way as that described in French Pat. Nos. 2 506 795 and 2 538 008 (corresponding to U.S. Pat. No. 4,544,001), the disclosure of which is herein incorporated by reference and their structure and functioning are as follows.

The feeding zone A is essentially constituted of a metering-delivering device (6) of any known type, for example of the type with rotating rollers (6*a*,6*b*). The weft yarn (7) comes from a feed bobbin (8) and passes through a shield (9), a brake (10) and a reciprocating guide or eyelet (11) which moves along the dotted line path of FIG. 1 to enable said weft yarn to be selectively subjected to the action of the metering delivering device (6) in a similar manner as the guide 9 of U.S. Pat. No. 4,544,001. At the outlet of the metering-delivering device (6), and close to the tangential line (12) between the rotating rollers (6*a*,6*b*), there is provided an assembly constituted in the same way as described in French Pat. No. 2 506 795, except that it only allows the guiding of one weft and not of several wefts as in the aforesaid patent. The assembly is composed essentially of a funnel-shaped chamber (13) designated hereinafter as a funnel, said chamber issuing into a channel (14) constituted by a tube provided with a split part (15) situated inside the throwing plane of the yarn into the shed. Between funnel (13) and channel (14), there is preferably provided a nozzle (16) which holds the yarn issuing from the metering delivering device (6) in a stretched condition and helps its introduction into the reserve, as explained hereinafter in more detail.

As regards the storage and throwing assembly B, this is constituted in the same way as described in French Pat. No. 2 538008, (corresponding to U.S. Pat. No. 4,544,001), the disclosure of which is herein incorporated by reference and is essentially composed of a reserve or storage chamber (17) used for temporarily accumulating a predetermined length of weft yarn (7) before this is thrown into the shed formed by the warp yarns (1).

Said storage chamber (17) comprises at its inlet side, a guiding channel (18) oriented in the direction of insertion of the weft into the shed and which is extended laterally by a split channel (19), which latter projects laterally with respect to the throwing rollers themselves (20*a*, 20*b*), the inlet (21) of this guiding channel 18 being situated opposite the outlet (22) of feeding channel (14). A gap is left between outlet (22) and inlet (21) in order to allow the yarn to be gripped by a positioning element (23) which may be similar to the positioning member 36 of U.S. Pat. No. 4,544,001. The positioning member 23 reciprocates along the dotted line of FIG. 1 to selectively introduce the yarn between the throwing rollers (20*a*, 20*b*) during the throwing operation. Also, to help the introduction of the weft yarn inside the storage chamber (17), a nozzle (24) is provided close to the bend formed between the split channel (19) and the guiding channel (18), so as to insufflate air inside said tube guiding channel (18).

In general, both assemblies A and B for supply and storage/throwing of the weft yarn, have a structure and operation which, as already indicated, are similar to those described in French Pat. Nos. 2 506 795 and 2 538 008 (corresponding to U.S. Pat.No. 4,544,001). To sum up, while the weft yarn is being metered before its insertion, under the action of the guide or (11), the yarn is brought between the metering-delivering device (6), passes through funnel (13), channel (14) and split and guiding channels (19) and (18), in order to come and accumulate in the reserve or storage chamber (17). During the throwing operation, the yarn is caught between the outlet and inlet (22) and (21) of channels (14) and (19) by the gripper element 23 in order to be brought in the tangential line of the throwing rollers (20*a*, 20*b*), and is thrown into the shed in the form of a loop (25) having one thrown portion (26) extending between the rollers 20*a*, 20*b* and a turning or bent area of the loop 25 and one fastened portion (27) extending between the turning or bent area of the loop and an end 30 of the split channel 14 adjacent the nozzle 16. As soon as the loop is formed inside the shed, the fastened portion (27) is caught by a clamping member (28) and is cut with scissors (29) situated close to the selvedge of the fabric (5) in a manner similar to the clamp 12 and scissors 13 of U.S. Pat. No. 4,544,001.

Figure 1C:
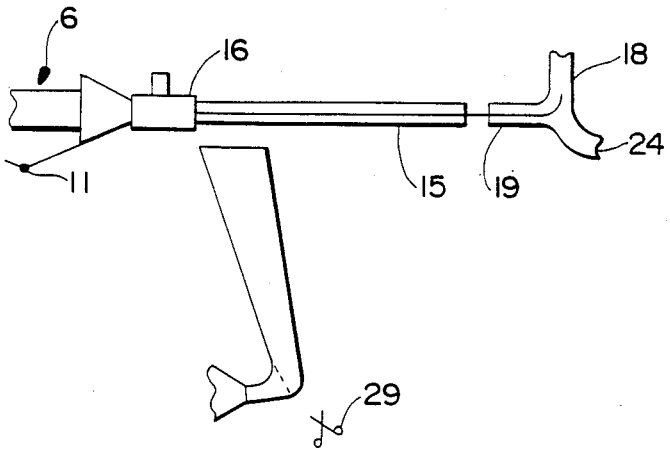
FIG. 1*c* is a diagrammatical side view showing the yarn after reintroduction into the tube 14 but before reintroduction into the storage chamber 17.

In order to solve the problems of holding the end of the yarn after cutting, as well as that of the re-introduction of that end into the reserve or storage chamber 7 for the next metering operation, according to the invention, the yarn situated between the scissors (29) and the outlet of the metering device (6), (and more particularly the yarn situated between the scissors 29 and the end (30) of the portion of the split channel (14) situated at the outlet of nozzle (16)) is held over in the circuit C, which is an essential characteristic of the present invention. Such a holding over circuit is constituted by an assembly whose structure is such that, according to the process of the present invention, the yarn which is thus held over, can be re-introduced into the reserve or storage chamber (17) in an unwound, linearly stretched condition by re-introducing the yarn progressively into the split channel (14). In particular, after the yarn is cut by the scissors 29, a suction nozzle 34 draws the yarn against the holding-over zone as indicated by the dashed thread line in FIG. 1. The free end of the yarn contained between the outlet nozzle (16) and the scissors (29) is re-introduced into the channel (14) in the form of a loop (shown in dotted line in FIG. 1) which progressively opens out or unwinds because the force of the nozzle 16 gradually overcomes the force of the suction nozzle 34. When completely unwound, the yarn is stretched by the nozzles 16 and 24 to reach the inlet (21) for admission into the reserve or storage chamber (17) as illustrated in FIG. 1*c*. The metering-delivering device (6) is only operated when the yarn is thus correctly linearly re-positioned in the channel (14) in an unwound stretched condition due to the conjugated action of the air issued from the nozzles (16) and (24), this permitting the accurate introduction of the yarn into the reserve. According to this embodiment, wherein only one weft yarn is used for weaving the fabric, the assembly for holding over the yarn after cutting is essentially constituted of a chamber (300) formed by two parallel plates (31,32) with a base (33) extending between the nozzle (16) and the scissors (29), said base being situated substantially in the weft yarn throwing plane. Said chamber is subjected to the action of a suction nozzle (34) which serves to hold the cut end of the yarn in a stretched condition. The side walls of said chamber help to guide and hold the yarn while said yarn is re-introduced into channel (14) for the next metering operation.

Also according to this embodiment, the distance between the nozzle (16) and the scissors (29) is slightly greater than the distance between the nozzle (16) and the zone of action of the nozzle (24) in guiding channel (18).

Figure 2:
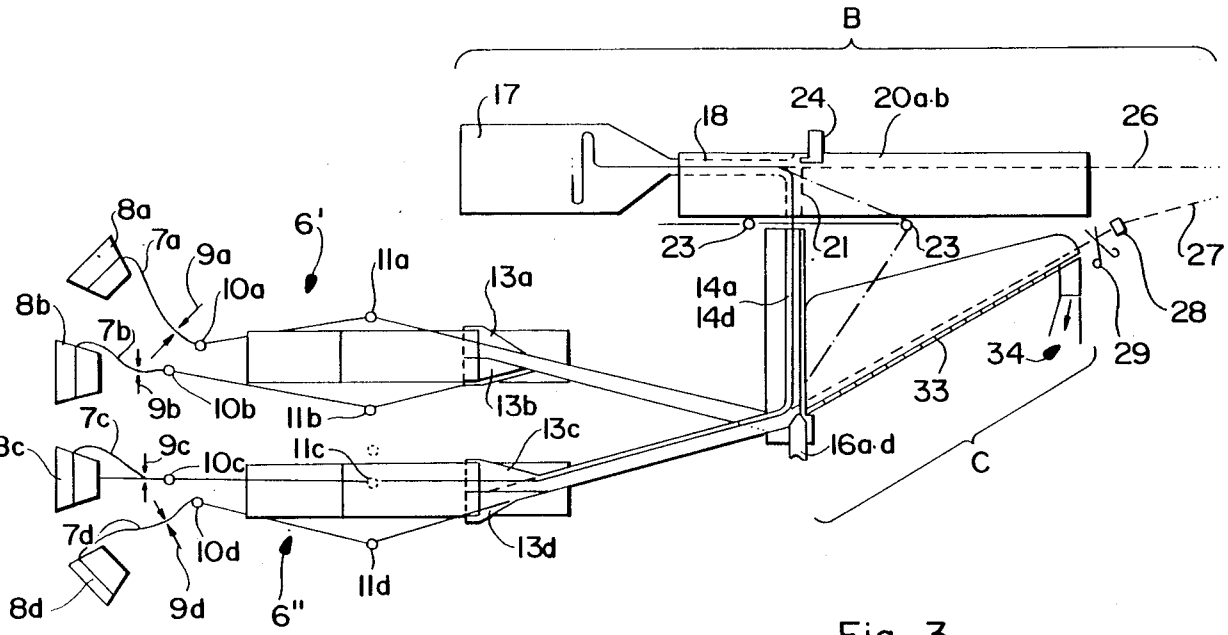
FIG. 2 is a diagrammatical view of a second embodiment according to the invention applicable to a multi-weft loom.
Figure 3:
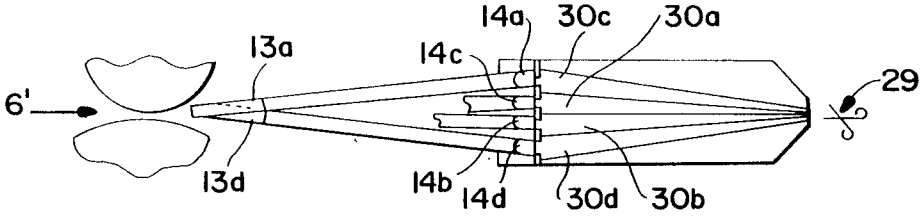
FIG. 3 is a plan view showing more particularly the circuits for holding over the weft yarns after the cutting operation.
Figure 4:
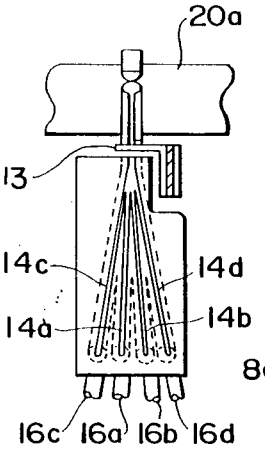
FIG. 4 is a side view showing how the cut ends are re-introduced into the reserve and how the yarn is caught for the throwing operation.

Such process and device are easy to adapt to multicolored looms as can be seen from the example illustrated in FIGS. 2, 3 and 4 which describes an embodiment for use with a four-color loom and corresponds to FIGS. 4–6 of U.S. Pat. No. 4,544,001. In this embodiment, the same references are used as those used in the preceding ones to designate the various elements of the assembly according to the invention, except that they all bear an index a, b, c, d to differentiate the four yarns.

According to this particular embodiment, the four yarns (7*a–d*) are fed from four bobbins (8*a–d*) and arrive in control eyelets (11*a–d*) after passing through shields (9*a–d*) and braking means (10*a–d*). Two metering devices (6′,6″) only are used for metering the four yarns, said yarns being arranged in pairs on either side of said metering devices and being subjected to their action at the right moment. The yarn (a) enters on the left side, and the yarn (b) on the right side of the metering device (6′), and likewise the yarn (c) enters on the left side and the yarn (d) on the right side of the metering device (6″).

The actual storage and throwing assembly is identical to that described in the preceding example, and therefore will not need to be described further.

According to this embodiment, the yarns are brought to said storage and throwing assembly as before, by means of an assembly comprising, for each yarn, a funnel (13*a–13d*), a blowing nozzle (16*a–16d*) and a split channel (14*a–14d*) directed to face the introduction orifice (21) of the tube (19) situated opposite the gripping zone between the throwing rollers (20*a–20b*). Then, in view of the plurality of circuits, funnels (13*a–13d*) and channels (14*a–14d*) diverge one from the other so that their inlet faces exactly towards the metering rollers gripping line (see FIG. 3), whereas on the contrary, the split channels (14*a–14d*) permitting the introduction of the yarn into the reserve converge towards that inlet (21).

As in the preceding examples, a circuit C, where the cut end of the yarn is held over, is provided between the scissors and the nozzles (16).

Such a holding-over circuit is constituted by the juxtaposition of four circuits similar to that described in the preceding example, and which are constituted of four superposed chambers constituted, for example, of plates. As particularly illustrated in FIGS. 2 and 3, said holding-over chambers (30*a–30d*) are oriented so as to converge towards the throwing plane itself.

Such a device works in the same way as the others, namely that after cutting, the free ends of the yarns are held by suction nozzles (34) inside holding chambers, and that during the throwing, the free end is first straightened out progressively under the action of nozzle (16) in order to be introduced in the form of a loop unwinding inside the split channel (14), wherefrom it is transferred into introduction channel (19) leading to the reserve (17). The weft yarn, due to be accumulated in the reserve, is only subjected to the action of its delivering device when said free end has been thus re-introduced in order to be stretched under the action of nozzle (24) in the circuit leading to the reserve, therefore the introduction can be carried out in a perfectly stretched out manner.

Compared with the solution proposed in French Pat. No. 2 538 008, the present invention offers many advantages by the fact that the part of yarn included between the metering device and the scissors is guided with accuracy, said part of yarn being intended to be subsequently re-introduced into the reserve, and by the fact that, if several different yarns have to be used, said yarns are held over outside the actual throwing circuit which, therefore, is not disturbed.

Also, during the throwing operation, the introduction between the throwing rollers is performed to perfection since it is possible to dispose the conduit (18) supplying the yarn orthogonally to the throwing rollers. Finally, with this solution, it is possible to modify at will the position of the feed bobbins and of the metering device with respect to the loom, placing them for example orthogonally as illustrated in FIGS. 1, 1*a*, 1*b* or on the contrary, in parallel to the selvedge as illustrated on the example of FIGS. 2, 3 and 4.

What is claimed is:

1. A process for inserting weft lengths into a shed of a loom, in which a metering-delivering device supplies a storage member for storing a predetermined length of yarns, said yarn length being caught between an outlet of the metering-delivering device and the storage member in order to be inserted into the shed formed by warp yarns, said yarn length being subsequently cut and gripped close to the selvedge of the fabric, a cut end of the yarn being held over before being re-introduced in the storage member for a subsequent insertion, said process comprising the steps of: holding over the cut end of the yarn in an independent circuit outside a path joining the outlet of the metering-delivering device to an inlet of the storage member, and re-introducing the yarn into the storage member so that the cut end is re-introduced as a loop unwinding from a fixed point at the outlet of the metering-delivering device as far as the inlet of the storage member under the action of an air stream, the weft yarn being only re-subjected to the action of the metering-delivering device when it has completely unwound and stretched out under the action of a nozzle.

2. In a device for inserting weft lengths into a shed of warp yarns in a loom in which at least one bobbin feeds weft yarn to at least one metering-delivering device for supplying a storage member that stores a predetermined length of weft yarns, said weft yarn lengths being caught between an outlet of the metering-delivering device and the storage member in order to be thrown through a weft yarn throwing plane and inserted into a shed formed by warp yarns, and cutting and gripping means are provided for cutting said weft yarn length and gripping it close to the selvedge of the fabric after insertion into the shed, the improvement comprising:

at least one holding-over means for holding over an end portion of the cut yarn by maintaining the end portion of the cut yarn in a stretched condition between the outlet of the metering-delivering device and the cutting and gripping means and re-introducing the end portion of the cut yarn into the storage member under the action of the metering-delivering device, said holding-over means being located between the outlet of the metering-delivering device and the cutting and gripping means close to the selvedge, and said holding-over means being located outside a yarn path extending between said metering-delivering device and storage member and between the storage member and the shed.

3. The device as claimed in claim 2, wherein the distance between a nozzle at the outlet of the metering-delivering device and the cutting and gripping means is slightly greater than the distance between the nozzle and a zone of action of a nozzle for the storage member.

4. The device as claimed in claim 2, wherein the holding-over means is disposed inside the throwing plane when used with a one color loom.

5. The device as claimed in claim 2, wherein a plurality of holding-over means are provided corresponding to the weft lengths to be inserted in a multi-color loom, said storage members being oriented so as to guide the yarn in a plane cutting through the throwing plane.

6. The device as claimed in claim 2, wherein the holding-over means comprises a chamber formed of two parallel plates, and a base which extends between the outlet of the metering-delivering device and the cutting and gripping means, said chamber being situated substantially inside the weft yarn throwing plane.

7. The device as claimed in claim 6, wherein said chamber includes a suction nozzle to hold the cut end of the yarn in the stretched condition for re-introduction into the storage member under the action of the metering-delivering device.

* * * * *